United States Patent [19]

Lepach et al.

[11] Patent Number: 4,971,264

[45] Date of Patent: Nov. 20, 1990

[54] METHOD AND APPARATUS FOR THE CONTINUOUS CHANGE OF REELS IN SINGLE OR MULTIPLE CONTINUOUSLY OPERATING WINDING STATIONS FOR STRAND-LIKE MATERIAL SUCH AS WIRE

[75] Inventors: Werner Lepach; Dieter Ferschl, both of Schwabach; Karl Jörg, Georgensgmünd, all of Fed. Rep. of Germany

[73] Assignee: Maschinenfabrik Niehoff GmbH & Co. KG, Schwabach, Fed. Rep. of Germany

[21] Appl. No.: 102,815

[22] Filed: Sep. 22, 1987

Related U.S. Application Data

[63] Continuation of Ser. No. 416,093, Sep. 8, 1982.

[30] Foreign Application Priority Data

Sep. 24, 1981 [DE] Fed. Rep. of Germany ..... 3137990

[51] Int. Cl.[5] ..... B65H 67/48

[52] U.S. Cl. ..... 242/25 A

[58] Field of Search ..... 242/25 A, 25 R, 18 R, 242/18 A, 35.5 A, 79

[56] References Cited

U.S. PATENT DOCUMENTS

| | | | |
|---|---|---|---|
| 2,527,667 | 10/1950 | Wood | 242/79 |
| 2,949,313 | 8/1960 | Moser et al. | 279/2 |
| 2,999,654 | 9/1961 | Fuller | 242/128 |
| 3,291,415 | 12/1966 | Bursk | 242/80 |
| 3,596,844 | 8/1971 | Engmann | 242/25 |
| 3,695,527 | 10/1972 | Kobayashi et al. | 242/25 A |
| 3,964,723 | 6/1976 | Schippers et al. | 242/35.5 A |
| 3,971,519 | 4/1976 | Ikegami et al. | 242/25 A |
| 4,007,882 | 2/1977 | Isoard | 242/35.5 A X |
| 4,023,743 | 5/1977 | Schippers | 242/35.5 A |
| 4,098,467 | 4/1978 | Engmann et al. | 242/25 A |
| 4,157,792 | 6/1979 | Wyckuys | 242/25 A |
| 4,369,928 | 1/1988 | Riekkinen et al. | 242/25 A |

FOREIGN PATENT DOCUMENTS

| | | | |
|---|---|---|---|
| 2049615 | 5/1971 | Fed. Rep. of Germany | 242/25 R |
| 2212506 | 11/1972 | Fed. Rep. of Germany | 242/25 A |
| 2448331 | 4/1975 | Fed. Rep. of Germany . | |
| 3042518 | 5/1981 | Fed. Rep. of Germany . | |
| 1280010 | 4/1972 | United Kingdom . | |

*Primary Examiner*—Stanley N. Gilreath

*Attorney, Agent, or Firm*—Kenyon & Kenyon

[57] ABSTRACT

A method and apparatus for the continuous changing of reels on continuously operating stationary winding stations for strand-like materials are disclosed. A reel changing apparatus having at least two reel receiving stations is provided. A full reel being wound on a winding station is removed from the winding station by a first reel receiving station of the reel changing apparatus which continues to rotate the removed reel at operating speed after reel removal. Strand-like material continues to be wound on the removed reel. A second reel receiving station of the reel changing apparatus which is rotating an empty reel at operating speed places the empty reel on the winding station from which the full reel had been removed. The empty reel rotates on the winding station at operating speed. The strand-like material is then cut and transferred to the empty reel rotating on the winding station. Reel change has been accomplished without interrupting the winding of the strand-like material. The full reel is deposited by the reel changing apparatus in a reel storage area. The reel changing apparatus proceeds to another winding station to perform another reel changing operation. A single reel changing apparatus can service a plurality of winding stations.

5 Claims, 3 Drawing Sheets

METHOD AND APPARATUS FOR THE CONTINUOUS CHANGE OF REELS IN SINGLE OR MULTIPLE CONTINUOUSLY OPERATING WINDING STATIONS FOR STRAND-LIKE MATERIAL SUCH AS WIRE

This application is a continuation of application Ser. No. 416,093, filed Sept. 8, 1982.

FIELD OF INVENTION

The invention relates to a method and apparatus for the continuous changing of reels in single or multiple continuously operating winding stations for strand-like material such as wire. The invention is particularly directed to a reel changing method and apparatus advantageously employed with two or more stationary winding stations which are arranged physically separate from each other.

BACKGROUND OF THE INVENTION

DE-AS 11 59 724 discloses a method and apparatus for continuous winding of strand-like material in which the winding reels are arranged positioned on a turntable in one plane. When reels are to be changed, the empty reels are brought into the winding position by rotating the turntable. The use of auxiliary reels plays an important role in this prior art apparatus. The auxiliary reels are arranged coaxially with the main reel and continue to wind up the strand-like material during the changing of the reels.

Another reel-changing apparatus is disclosed in DE-OS 20 49 615. This prior art apparatus provides a movable unit for several stationary winding stations. A motor-driven auxiliary reel is placed in front of a reel for which winding is completed. The wire strand is transferred from the completed reel to the auxiliary reel and continues to be wound thereon until the wire is cut off.

The winding process onto the auxiliary reel is continued when the movable unit with the auxiliary reel is pushed on a track to one side of the winding station so that the completed reel can be removed from the winding station and an empty reel inserted. Then, the movable unit with the auxiliary reel moves in line in front of the axis of the empty reel which has been put in place in the winding station. The winding of the wire is then transferred from the auxiliary reel to the empty reel.

The known prior art methods and apparatuses for changing reels have several disadvantages. A relatively long time interval is required for changing reels. Special auxiliary reels are required. A large amount of wire is accumulated on the auxiliary reels and this wire is scrap. At today's high operating speeds, the amount of scrap is no longer negligible.

OBJECT OF THE INVENTION

It is therefore an object of the present invention to provide a method and apparatus for the changing of reels in continuously operating single or multiple strand-like material winding stations wherein the accumulation of scrap material is avoided.

It is a further object of the present invention to provide such a method and apparatus wherein the reel changing time is reduced to a minimum.

It is yet another object of the present invention to provide such a method and apparatus wherein the changing of reels can be performed completely automatically, without jerking even for thicker wires, and without manual assistance.

It is still another object of the present invention to provide a method and apparatus for the changing of reels in continuously operating single or multiple strand-like material winding stations which will result in a reduction in the overall investment in plant and manufacturing costs.

It is yet a further object of the present invention to provide such a method and apparatus which is of a simple and reliable design.

It is still another object of the present invention to provide such a method and apparatus wherein one reel changing apparatus may be used with a plurality of continuously operating stationary winding stations.

These and other objects will become apparent from the following description and claims in conjunction with the drawings.

SUMMARY OF THE INVENTION

The present invention is directed to a method and system for changing reels on a continuously operating wire winding station without interrupting the winding operation or producing accumulation of scrap material. A rotatable arm is provided having rotatable spindles mounted on each end thereof. When a reel is to be changed, the rotatable arm is moved adjacent the winding station. The arm is rotated and lowered into position whereby a first rotating spindle engages the full reel. An empty reel is engaged by the second rotating spindle and rotated thereby. The arm is raised and rotated, e.g., 180 degrees and the full reel is thereby removed from the winding station. The full reel is being rotated by the first spindle after it is removed from the winding station and therefore the winding operation continues. The empty reel which is being rotated by the second spindle is placed on the winding station by lowering the arm. The wire is cut and clamped onto the empty reel. The winding operation continues without interruption or the production of scrap.

The present invention also comprises an apparatus for the practice of the foregoing method. In the preferred embodiment of the present invention, only one reel changing apparatus is provided for the servicing of two or more stationary winding stations. The invention is particularly contemplated for use in the wire winding industry.

BRIEF DESCRIPTION OF THE DRAWING

In the drawing forming part hereof.

DESCRIPTION OF THE PREFERRED EMBODIMENTS

Figure 1:
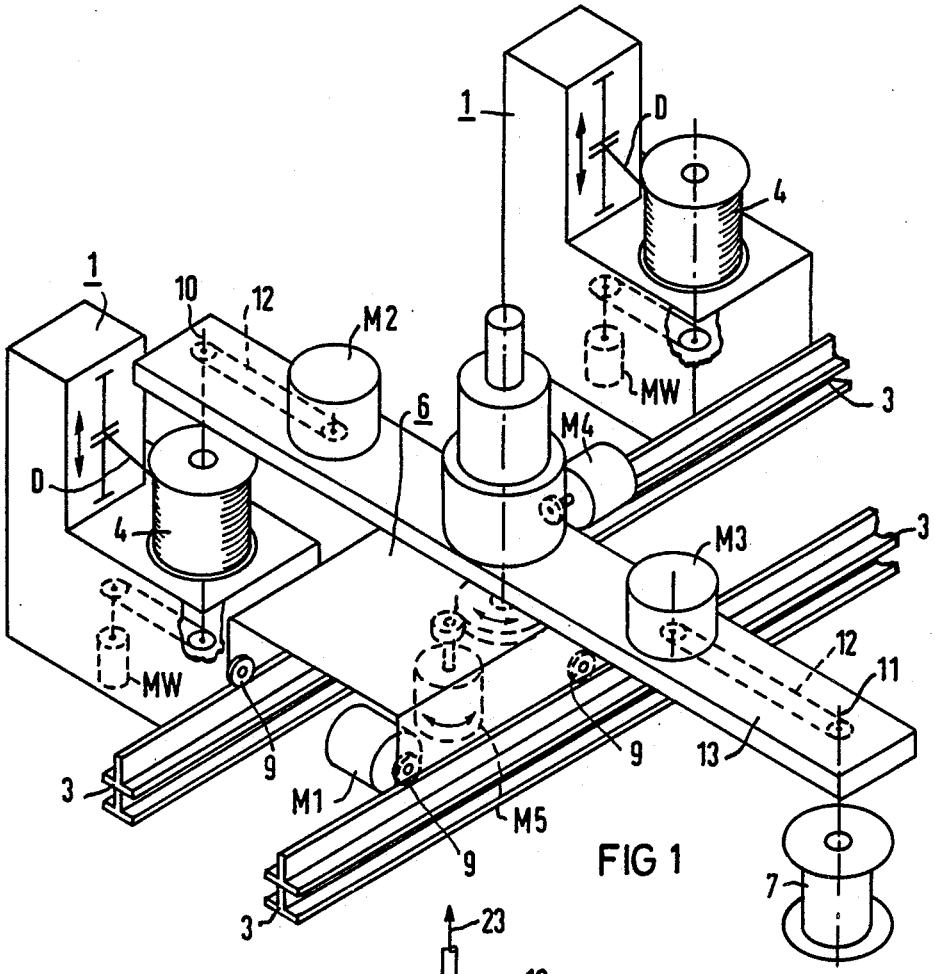
FIG. 1 is a perspective view of two stationary winding stations with a movable reel changing apparatus in accordance with one embodiment of the present invention.
Figure 5:
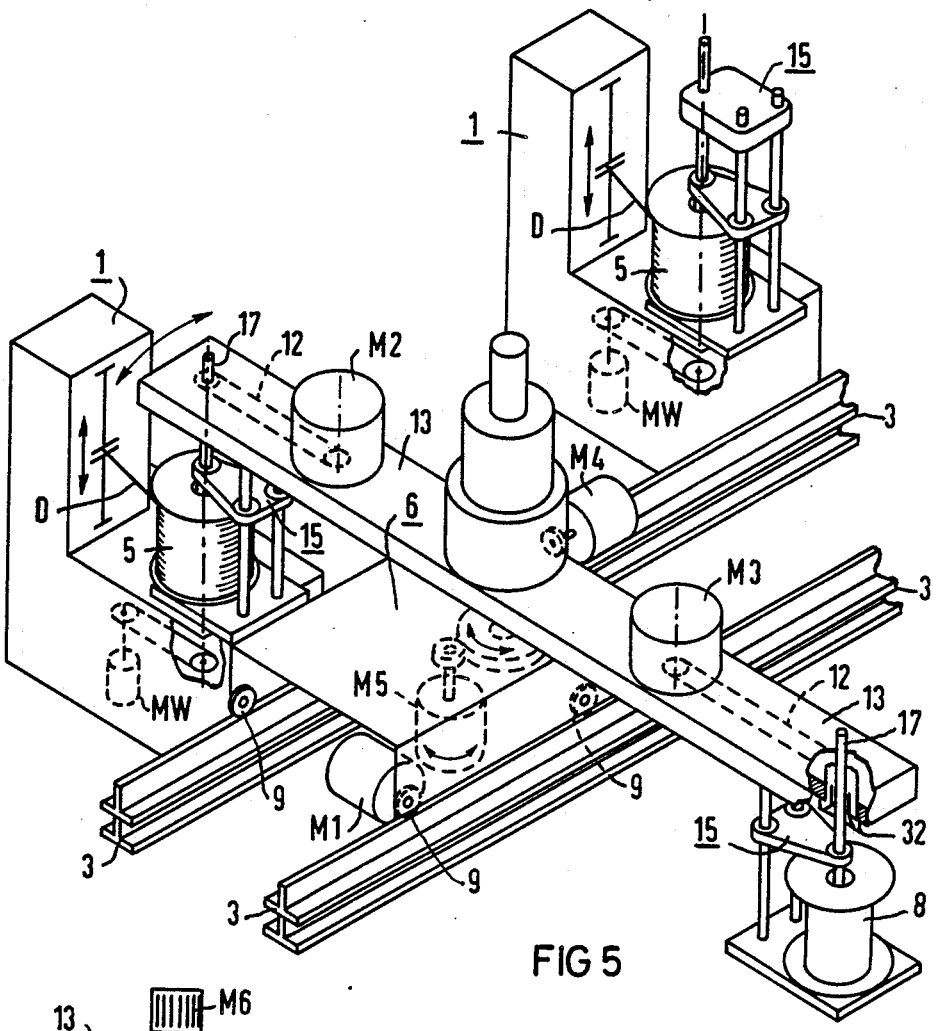
FIG. 5 is a perspective view of two stationary winding stations with a movable reel changing apparatus in accordance with another embodiment of the present invention wherein the reel changing apparatus is provided with cassette-like devices for holding reels.

In order to afford a more complete understanding of the present invention and an appreciation of its advantages, a description of the preferred embodiments is presented below;

FIGS. 1 and 5 illustrate two individual stationary winding stations which may be disposed, for example, adjacent to a track 3. It will hereinafter become appreciated that the present invention may be practiced with more than two stationary winding stations if so desired.

Each winding station 1 has a vertical reel spindle for receiving a reel 4, 5 which will be wound with wire or another strand-like material. Each winding station 1 may be provided with a motor MW for driving the spindle. The motor MW may be connected to the spindle in any convenient manner such as by a belt drive and conventional gearing. Such winding stations are well-known in the art and need not be described in detail for an appreciation and understanding of the present invention.

One skilled in the art will also find it convenient to locate in the vicinity of the stationary winding stations 1 and track 3 areas for storing a supply of empty reels and areas for receiving fully wound reels. The winding stations 1 may also be combined with a strand-material producing machine such as a wire drawing machine and/or varnishing or tinning apparatus. If desired, the winding station apparatus may be driven by a motor associated with a wire-drawing machine or a wire varnishing machine instead of having its own motor MW. These are all details (not illustrated) which may be readily provided for by one skilled in the art.

A reel changing device comprising a housing 6 and a rocker arm 13 is mounted for movement on tracks 3 by rollers 9 which are rotatably mounted to housing 6. The reel changing device may be moved in front of either of the winding stations 1 by a motor M1 mounted to housing 6 which may be connected to some or all of rollers 9 in any convenient manner (not illustrated). When a reel 4, 5 on one of the winding stations 1 is fully wound to its desired degree, the reel changing apparatus 6 is moved in front of the appropriate winding station 1 in order to replace a fully wound reel 4, 5 with an empty reel 7, 8. The rollers 9 may be then locked to keep the reel changing apparatus in position.

Rotatably mounted on housing 6 of reel changing apparatus is rocker arm 13. On each end of rocker arm 13 is rotatably mounted a vertically oriented downwardly extending reel spindle 10, 11. Motor $M_2$ is mounted on rocker arm 13 for driving reel spindle 10. Motor $M_3$ is mounted on rocker arm 13 for driving reel spindle 11. These motors $M_2$, $M_3$ may be connected to reel spindles 10, 11 in any convenient manner such as a belt drive 12.

Housing 6 has also mounted thereon a swivel motor M5 for rotating rocker arm 13 of the reel changing apparatus in a horizontal plane about its central vertical axis. The mechanical connections may be provided in any convenient manner. For example, a drive gear may be mounted on drive shaft of motor $M_5$. The drive gear may then drive another gear which is mounted on a shaft for rotating rocker arm 13. A motor $M_4$ is mounted on rocker arm 13 for driving appropriate mechanisms for selectively raising or lowering rock arm 13 with respect to housing 6 in the vertical direction. Any convenient mechanical arrangement may be used.

Changing of a reel which has been wound is accomplished as follows. An empty reel 7 is engaged by spindle 11 at the empty spindle storage area. (Preferred means for a spindle engaging a reel are hereinafter discussed in conjunction with FIGS. 2 and 3). The reel changing apparatus 6 is brought into position in front of the appropriate stationary winding station 1 having the full reel. Prior to the bringing of reel changing apparatus 6 into position in front of the appropriate winding station 1, rocker arm 13 has been raised vertically upward by motor $M_4$ so spindle 11 will clear the reel 4. The spindle 10 is brought up to the speed of rotation of the finished reel 4 by motor $M_2$ via belt drive 12. Rocker arm 13 is then lowered in the vertical direction by motor $M_4$ such that spindle 10 is lowered to reel 4 and clamps the reel (for example, by one of the means to be hereinafter discussed). The continued driving of reel 4 can now be entirely taken over by motor $M_2$.

The motor $M_3$ brings spindle 11 and thus empty reel 7 up to the speed of rotation of finished reel 4, i.e., the operating speed of the wire D to be wound up.

The finished reel 4 is released from the drive of motor MW of stationary winding station 1. The rocker arm 13 with the reels 4 and 7 suspended therefrom on both sides is lifted by motor $M_4$ and turned 180° by means of swivel motor $M_5$. The direction of the 180° rotation may be either clockwise or counter-clockwise. The two reels have now exchanged places. Subsequently, the still empty reel 7 is coupled to drive motor MW of the winding station 1 which has been brought up to the appropriate speed. The wire D which is still running at the synchronous speed and still being fed onto reel 4, is then cut and fastened onto empty reel 7 and wound onto empty reel 7 without interruption.

The finished reel 4 is now braked e.g. by motor $M_2$or any other convenient braking means and the end of the wire is secure by any of the conventional means such as cementing, twisting or knotting. The formerly empty reel 7 upon which has already been wound several turns of wire is detached from the spindle 11 and rotation of reel 7 is taken over completely by stationary winding station 1.

The reel changing apparatus 6 is then moved away from the winding station 1 along tracks 3 and deposits the finished reel 4 at a predetermined storage area which may be conveniently located near a storage room. The reel changing apparatus 6 next picks up an empty reel and is available for reel exchange at another winding station.

It will be appreciated that an important feature of the present invention is that one reel changing apparatus is capable of servicing a plurality of winding stations without interrupting of the wire winding process, without the use of auxiliary reels, and without the production of scrap.

The practice of the present invention may be further understood in conjunction with FIGS. 7A through 7F. In all of FIGS. 7A through 7F, the winding station is designated as 1, and the rocking arm is designated as 13. The rocking arm 13 rotates about point P.

Figure 7:
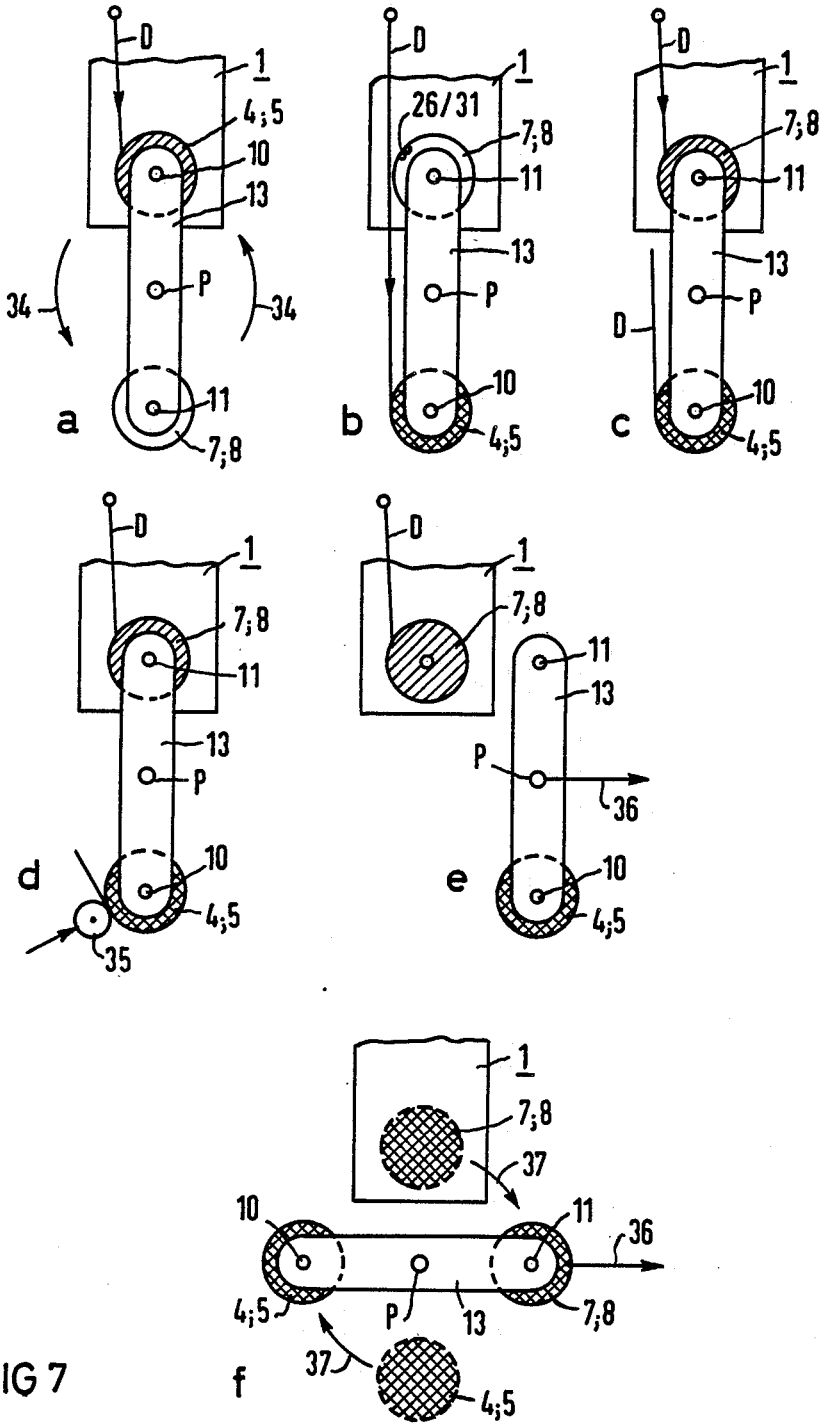
FIG. 7A through 7F illustrate a method for the practice of one embodiment of the present invention.

In FIG. 7A, an incoming wire D is being wound on the reel 4, 5. The other end of the rocking arm 13 already carries an empty reel 7, 8 which can rotate on spindle 11. Shortly before the end of winding wire on reel 4, 5 and while the winding operation on reel 4, 5 is still proceeding, the rocking arm 13 is swung 180° around pivot point P [e.g., in the direction of arrows 34 in FIG. 7A] so that the position shown in FIG. 7B is reached.

In FIG. 7B, the so far empty reel 7, 8 has arrived at the winding station 1 and has already been brought up to the synchronous speed by the motor $M_3$. Then the drive motor MW of the stationary winding station 1 which has been adjusted to the synchronous speed takes over the further drive of the empty reel 7, 8. The drive motor $M_3$ is disengaged. The rocking arm 13 is swung so far that the catching and cutting device 26, 31 [an example of which is hereinafter discussed in detail in connection with FIGS. 4 and 4A] can seize the arriving wire D, sever the wire D and secure the now start of the wire on the still empty reel 7, 8. This state is shown in FIG. 7C.

The wire at the winding station 1 continues to run and is wound on reel 7, 8. The rotation of full reel 4, 5 is discontinued and the wire D is secured to reel 4, 5 by a fixing device 35 such as a cementing device as is shown in FIG. 7D.

The reel changing apparatus 6 with the rocking arm 13 from which the full reel 4, 5 is suspended can now be transported to a storage area or another deposit area for example, as shown by the direction of the arrow 36 of FIG. 7E. An empty reel is then picked up at an empty reel storage area. If the rocking arm 13 must be transported past a winding station, it must be in a raised position.

The rocking arm 13 may also be rotated to a 90° position, as shown in FIG. 7F, whereby it can travel to a storage area [indicated by arrow 36] for the exchange of a full reel for an empty reel with concern for lateral space limitation.

If the winding station is not running continuously for any reason, such as the end of a shift, the rocker arm 13 can be swung 90° in the direction of arrow 37 as shown in FIG. 7F and run with both reels 4, 5 and 7, 8 full in the direction of arrow 36 to the storage area.

Figure 2:
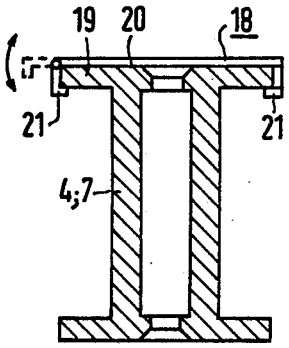
FIG. 2 is an elevation view of a gripping device used with the reel changing apparatus of the present invention illustrated in FIG. 1 which grips the upper flange of a reel (illustrated in cross-section)
Figure 3:
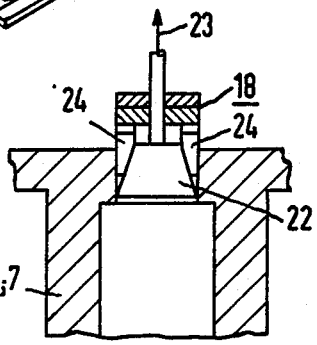
FIG. 3 is an elevation view partially in cross-section of a gripping device used with the reel changing apparatus of the present invention illustrated in FIG. 1 which clamps a reel in its central bore by means of a spreadable mandrel and then selectively releases the reel.

FIGS. 2 and 3 illustrate examples of devices for gripping reels which may be used in the present invention. In FIG. 2, the reel flange 19 is covered by a support plate 20 which is provided at several points about its circumference with claw-like grippers 21 which extend around and grasp the edge of the reel flange 19. A gripper is shown in phantom in a non-gripping position. The support plate 20 serves to prevent the reel 4 from canting. The grippers 21 may be routinely actuated by known electrical, pneumatic, or hydraulic power devices (not shown).

In FIG. 3, the gripping device comprises a cone 22 inserted into the center bore of the reel. The cone 22 pushes wedge-shaped pressure pieces 24 distributed about its circumference outward against the inside wall of the bore or hole of the reel when the cone 22 is subjected to a pulling force in the direction of arrow 23. A firm connection is established. In some instances, a combination of the two types of fastenings shown in FIGS. 2 and 3 may be advantageously used.

Figure 4:
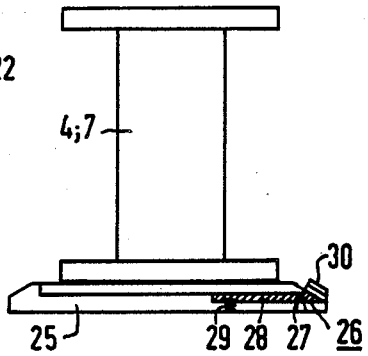
FIG. 4 is an elevation view of a reel mounted on a rotating reel pad of a stationary winding station illustrated in FIG. 1.
Figure 4A:
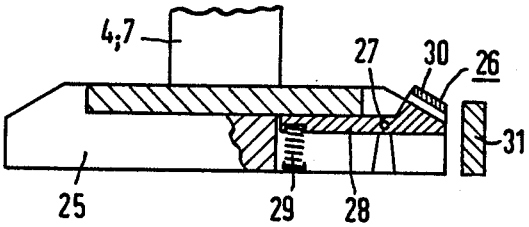
FIG. 4A is an enlarged fragmentary view of the rotating reel pad of FIG. 4 showing in cross-section a wire catching device and counter-blade.

FIGS. 4 and **4*a* illustrate a reel pad 25 which is mounted for rotation on stationary winding station 1. The reel pad 25 receives the reel 4, 7** and rotates with the received reel.

The reel pad 25 includes a wire catching device which rotates with the reel pad which functions to clamp the wire D to start the winding of a wire on an empty reel and also to cut the wire when a first reel is full and the winding of the wire is to be started on a second empty reel which has been placed in position on the stationary winding station 1 as has been hereinbefore discussed in conjunction with FIGS. 7A through 7C.

The wire catching devices 26 comprises a two-armed lever 28 which is mounted by fulcrum 27. On a first end of the lever arm 28 at the outer circumference of the reel pad 25 is a claw-member 30 for grasping a wire. The claw-member 30 has associated therewith a counter-blade 31 (illustrated broken away) for cutting a grasped wire. The use of such blades for cutting a wire are known in the art. The second end of lever 28 is supported against spring 29 when a reel 4, 7 is in place and released when a reel 4, 7 is removed for releasing a clamped wire.

If desired, the wire catching device 26 may be constructed with fulcrum 27 positioned so that the weight of claw end 30 of lever arm 28 is greater than the other end, the lever will be released under the influence of its own weight when a reel 4, 7 is removed.

Figure 6:
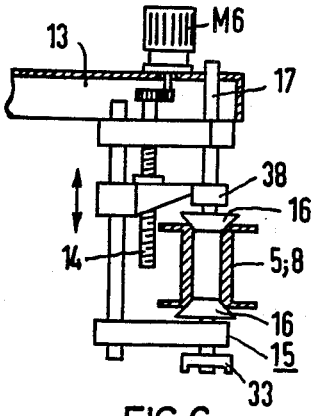
FIG. 6 is a detail of the cassette-like devices illustrated in FIG. 5.

The embodiment of the invention illustrated in FIG. 5 differs from that of FIG. 1 only in that the finished reel 5 and the empty reel 8 are each accommodated in a cassette-like device 15 which is illustrated in simplified detail form in FIG. 6.

In FIG. 6, a reel 5, 8 is illustrated disposed in cassette-like device 15 and supported therein on two sides by axially movable and lockable cones 16 so that reels of different length and/or diameter can be used and wires with larger diameter and/or with coatings of heavier material can be wound. One skilled in the art will be able to provide supporting means different from cones 16.

The cassette-like device 15 including the reel 5 or 8, respectively, from a single structural unit which is provided, for example, with, among other things, a spindle 17. By inserting the spindles 17 into gripping devices 32 mounted in both ends of rocker arm 13, the spindles 17 are gripped and driven by motors $M_2$ and $M_3$. As illustrated in FIG. 6, a coupler 33 is provided for connection to the drive means of the winding station 1 so that the reel may be driven, for example, by motor MW, during the wire winding process. The reels 5, 8 suitably remain inside the cassettes 15 during all the process steps. The reels are inside the cassettes 15 when they are loaded empty into a winding station 1 and when they are fully wound and removed from a winding station 1.

It is also possible to have the reel changing apparatus 6 itself perform the insertion and removal of an empty reel 8 into and out of the cassette-like device 15. To accomplish this an addition motor M6 may be mounted on rocker arm 13 as illustrated in FIG. 6. Motor 6 would be connected by appropriate gearing and mechanisms to an additional spindle 14 for raising and lowering spindle 14 in the axial direction as indicated by the arrow in FIG. 6. Spindle 14 is connected by horizontal support member to holder 38 which is thereby raised or lowered in the axial direction and thereby the clamping cones 16 are clamped or opened.

The advantages of the method and apparatus of the present invention will now be apparent. The entire production of a plurality of winding stations can be continuously wound on reels without the production of scrap and without process interruption by means of a relatively few process steps and with a minimum of apparatus parts. The fully wound reels, if desired, may be taken to a storage area and the winding stations may be supplied with empty reels practically without any loss of time. One reel changing apparatus can service a plurality of winding stations.

The present invention makes it possible, without the large expenditures such as are required, for instance, in computer controlled plants, to create a plant of simple design which is easy to operate, is comparatively inexpensive and which can be operated using known electrical circuits. The apparatus of the present invention is to provide control valves, locking devices, switches, control and regulating devices (not shown) of conventional known constructions so that the apparatus of the present invention may be put into operation with any known program or follower circuits of the simplist kind.

Although preferred embodiments of the present invention have been described in detail, the method and apparatus of the present invention is not limited to the embodiments and examples disclosed herein. One skilled in the art will now readily appreciate that it would be possible, for example, to mount the winding stations as well as the reel changing apparatus such that the axes of the reels and the spindles are at an angle or horizontal in addition to the vertical embodiments. It is further possible to arrange the rocker arm 13 such that instead of a single rocker arm 13 there are at least two such arms, for example, in the form of a cross, so that the rocker arms can be used at least temporarily for the storage of full or empty reels. Accordingly, the number of trips of the reel changing apparatus to the full reel storage area or the empty reel pickup area can be substantially reduced. It is further contemplated that one skilled in the art will be able to readily provide many variations in the details of the mechanical design all within the spirit and scope of the invention.

What is claimed is:

1. A method for changing reels in a stationary continuously operating winding station for strand-like material comprising:

providing at least two spaced apart stationary winding stations;

winding strand-like material on a reel received by each of said winding stations to a preselected degree of fullness by rotating said reel at a preselected operating speed;

providing a reel changing apparatus comprising a first reel receiving station having a rotatable spindle and a second reel receiving station having a rotatable spindle;

disposing an empty reel on said first reel receiving station spindle;

moving said reel changing apparatus adjacent one winding station;

rotating said second reel receiving station spindle at said preselected operating speed;

engaging said reel being wound with wire on said one winding station with said second reel receiving station spindle rotating at said preselected operating speed wherein said second reel receiving station rotating spindle takes over rotating said reel being wound with wire at said preselected operating speed;

rotating said first reel receiving station spindle having said empty reel disposed thereon at said preselected operating speed whereby said empty reel rotates at said preselected operating speed;

removing said reel being wound with wire from said one winding station when said reel is wound to said preselected degree of fullness by displacing said second reel receiving station from said one winding station while continuing to wind wire on said reel by said rotation of said second reel receiving station spindle;

placing in said one winding station said empty reel being rotated at said preselected operating speed by said rotation of said first reel receiving spindle by displacing said first reel receiving station;

fastening said wire to be wound to said empty reel rotating at said preselected operating speed in said one winding station substantially simultaneously with cutting said wire to discontinue wire winding on said wound reel whereby said wire winding operation remains substantially uninterrupted;

disengaging said first reel receiving station spindle from said empty reel wherein said one winding station takes over rotating said empty reel at said preselected operating speed;

continuing winding of wire on said empty reel at said one winding station;

moving said reel changing apparatus to another winding station for repeating said method steps.

2. A method as recited in claim 1 further comprising:

braking said wound reel rotating on said second reel receiving station spindle after said cutting of said wire;

securing the end of the cut wire wound on said wound reel engaged by said second reel receiving station;

depositing said wound reel engaged by said second reel receiving station in a preselected storage area.

3. A method as recited in claim 1 wherein a plurality of winding stations and one reel changing apparatus are provided.

4. A method as recited in claim 1 wherein said strand-like material is wire.

5. A method as recited in claim 1 wherein said reels rotate about a vertical axis.

* * * * *